US011651754B2

(12) United States Patent
Strickland

(10) Patent No.: US 11,651,754 B2
(45) Date of Patent: May 16, 2023

(54) PRESSURE DRUM DAMPER FOR A PERCUSSIVE INSTRUMENT

(71) Applicant: Mathew E Strickland, Burlingame, CA (US)

(72) Inventor: Mathew E Strickland, Burlingame, CA (US)

( * ) Notice: Subject to any disclaimer, the term of this patent is extended or adjusted under 35 U.S.C. 154(b) by 0 days.

(21) Appl. No.: 16/873,655

(22) Filed: May 28, 2020

(65) Prior Publication Data

US 2021/0375242 A1 Dec. 2, 2021

Related U.S. Application Data

(60) Provisional application No. 62/921,080, filed on May 30, 2019.

(51) Int. Cl.
*G10D 13/14* (2020.01)
*G10D 13/02* (2020.01)

(52) U.S. Cl.
CPC ..... *G10D 13/14* (2020.02); *G10D 13/02* (2013.01)

(58) Field of Classification Search
CPC ..... G10D 13/14; G10D 13/02
See application file for complete search history.

(56) References Cited

U.S. PATENT DOCUMENTS 4,671,158 A * 6/1987 Saputo ..... G10D 13/14 984/151
6,307,133 B1 * 10/2001 May ..... G10D 13/14 181/161
2016/0335995 A1 * 11/2016 Asarisi ..... G10D 13/02

* cited by examiner

*Primary Examiner* — Jianchun Qin
(74) *Attorney, Agent, or Firm* — West & Associates, A PC; Stuart J. West

(57) ABSTRACT

A drum damper includes a first body having a first surface and a second surface, and the first body includes a slot and a fader button positioned on the first surface of the first body and configured to slide along the slot. A second body is connected with the second surface of the first body and configured to releasably attach with a drum. Flexible bodies are connected with the second body, configured to dampen sound or vibration from a drum head and be in contact with the drum head, and connected with the fader button through the slot so that, when the fader button slides along the slot, the flexible bodies increase or reduce surface area contact with the drum head.

27 Claims, 15 Drawing Sheets

PRESSURE DRUM DAMPER FOR A PERCUSSIVE INSTRUMENT

CROSS-REFERENCE TO RELATED APPLICATIONS

This application claims priority to and the benefit of U.S. Provisional Application No. U.S. 62/921,080 filed May 30, 2019, the entire disclosure of which is hereby incorporated by reference.

FIELD

This disclosure relates to drum instruments used in music, and particularly, this disclosure relates to drum accessory hardware used to change the sound of a drum.

BACKGROUND

Drummers, which may be referred to as users, have always looked for ways to control the sustain of a drum since they started playing them. Currently, they often buy drum heads comprised of different layers of plastic that try to control the sustain in a multitude of ways. There are many tonal problems with this approach as the true tambour of their special drum is lost to un-resonating plastic limiting the actual vibration of a wood or metal drum. It is my belief that these drum head manufacturers have gone down the wrong path for about 40 years by adding so many layers of plastic and foam material to control the sustain of a drum, the true resonant tone of the core instrument is sorely sacrificed. Previous drum enhancers and dampers include those described in U.S. Pat. No. 8,541,675 B2, U.S. Pat. Nos. 9,711,116, 4,567,807, 6,696,630 B2, and U.S. Pat. No. 9,159,305.

SUMMARY

This accessory hardware is removably secured or permanently secured to a drum and is configured to come in contact with the vibration characteristics of a drum head for a percussive instrument to alter the sound of a drum. Disclosed herein are drum dampers that can precisely alter the time of resonance of a drum head to create a desired length of sustain of the drum.

Disclosed herein is a drum damper includes a first body having a first surface and a second surface, and the first body includes a slot and a fader button positioned on the first surface of the first body and configured to slide along the slot. A second body is connected with the second surface of the first body and configured to releasably attach with a drum. Flexible bodies are connected with the second body, configured to dampen sound or vibration from a drum head and be in contact with the drum head, and connected with the fader button through the slot so that, when the fader button slides along the slot, the flexible bodies increase or reduce surface area contact with the drum head.

Disclosed herein is a drum assembly that includes a drum, and the drum includes a drum rim, including an aperture, and a drum head connected to a top edge of the drum rim. The drum assembly also includes a drum damper that includes a first body having a first surface and a second surface that includes one or more slots and a threaded fader button positioned on the first surface of the first body and configured to slide along the one or more slots. The drum assembly also includes a second body connected with the second surface of the first body and a thumb screw configured to secure the drum damper and the drum together through the aperture of the drum rim and interfaced with the threaded fader button so that, when the thumb screw is rotated, the threaded fader button is slidable along the one or more slots. The drum assembly also includes flexible bodies connected with the second body, configured to dampen sound or vibration from the drum head and be in contact with the drum head, and connected with the threaded fader button through the one or more slots so that, when the threaded fader button slides along the one or more slots, the flexible bodies increase or reduce surface area contact with the drum head.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
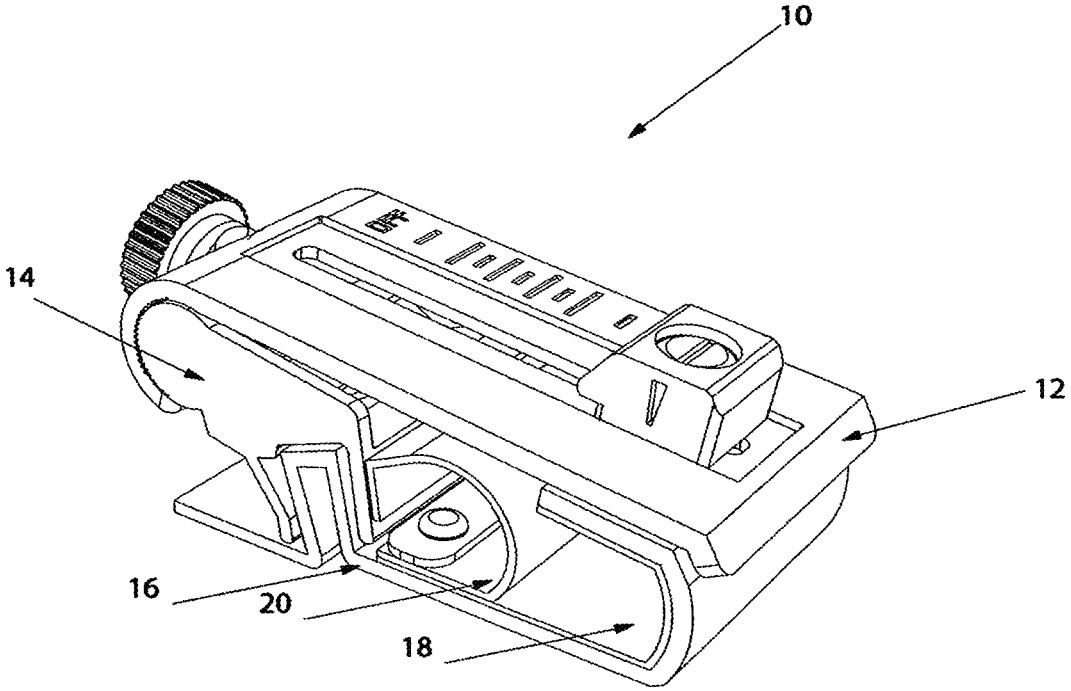
FIG. 1 is a perspective view of a drum damper.

This accessory hardware is removably secured to a drum and is configured to come in contact with the vibration characteristics of a drum head for a percussive instrument to alter the sound of a drum. Disclosed herein are drum dampers that can precisely alter the resonance of a drum head to create a desired length of sustain of the drum.

Disclosed herein are embodiments of a drum damper that can be removably secured to a drum then adjusted in a multiple of ways to achieve the desired sustain of a drum.

One aspect of this disclosure is a drum damper configured to removably attach to a drum hoop by the user, pulling apart both flexible surface ends and letting go via a spring clip. Some spring clips are discussed in U.S. Pat. No. 9,711,116, which is incorporated herein in its entirety. The drum damper comprises a first main body that attaches to a second body and the flexible surfaces. The drum damper comprises an arced locking thumb screw to secure the first body to the second body. The drum damper also comprises a set of flexible surfaces that can be moved with a dial via an open slot located within the first body.

Another aspect of this disclosure is a drum damper that presents the option for the user to put a desired amount of pressure on the drum head to alter the length of sustain of a drum. The drum damper is comprised of a first body hinged to a second body with teeth. These teeth allow the user, after loosening a thumb screw, to accurately move the first surface in contact with the flexible surfaces to a desired angle, then tighten the locking thumb screw holding in place the angle and creating the pressure of the arced flexible surface in contact with the drum head to a desired firmness.

Another aspect of this disclosure is a drum damper that has at least one or more flexible surfaces that can independently be adjusted for more or less firmness on the drum head for dampening.

Another aspect of this discloser is a drum damper that has a hook within the second body to secure a second flexible surface. This flexible surface can be rolled up and secured on the second body creating a downward force to keep the other flexible surfaces flat against the drum head during dampening.

In some implementations of the drum damper, it can be removably secured on the outside rim of a drum.

In some implementations of the drum damper, it can be configured to work on the inside shell of a drum by utilizing the screws from the lugs that secure the lugs to the drum.

These and other features, aspects and advantages of this disclosure will become better understood with reference to the following drawings and description.

With the pressure drum damper, either as a drum accessory that attaches to the hoop or built within the drum, the user can have three ways of controlling the sustain. The user can adjust the downward pressure, the firmness of the damper's flexible surfaces, and the surface area on the drum via the dial, all of which play a role in finding the right sustain for the user.

An advantage of the pressure drum damper is that the user can tune their drum low or high and adjust the sustain from the pressure damper. In the past, drummers would tune around the long resonance and finding the right balance between top and bottom heads was difficult and time consuming. Now a drummer can simply adjust the dial on the top or bottom head until they sound in tune and the length of the resonance is perfect.

FIG. 1 is a perspective view of a drum damper according to one embodiment and is not intended to limit the scope of the disclosure. The drum damper 10 includes a first body 12 and a second body 14. It includes one or more flexible bodies 16, 18, and 20.

Figure 2:
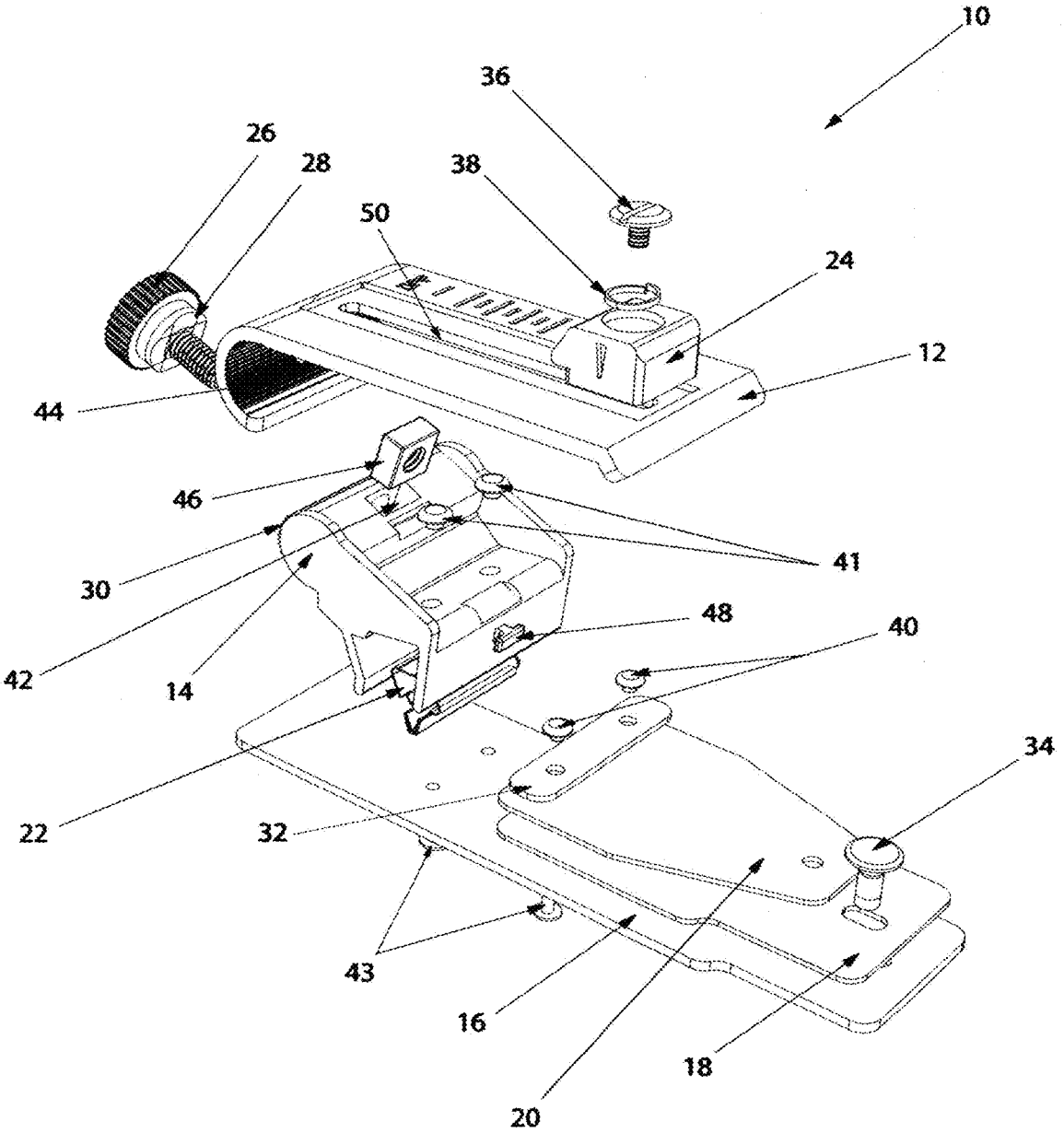
FIG. 2 is an exploded view of a drum damper of FIG. 1.

FIG. 2 is an exploded view of a drum damper 10. The drum damper 10 has a series of parts that are instrumental once assembled to create a fully adjustable drum damper. First body 12 is a rigid surface. Second body 14 is a flexible or rigid body. There are three flexible surfaces 16, 18 and 20. The flexible surfaces maybe described as a first flexible surface 16, a second flexible surface 18, and a third flexible surface 20. 22 is a spring clip while 24 is the fader button. 26 is the thumb screw with a self-locking arc 28. 46 is the square rigid nut going into a slot 42. 32 is a rigid plate used to hold the flexible surfaces 16, 18, 20 together evenly. 34 is the female end of a Chicago Screw while 36 is the male end of a Chicago Screw. 38 is a spring washer. 40 are the four sets of rivets. 44 are the teeth located inside the hinge arc of the first body 12. 30 are the teeth located inside the outside arc of the second body 14. 48 is the hook for the flexible surface 20.

The first body 12 can be made of metal, alloy, wood, plastic, rubber, aluminum or any combination thereof. The second body 14 can be made of any rubber, plastic, or any other flexible material. Preferably, the second body 14 is made of a firmer flexible material. The flexible surface 16 can be made of any rubber, plastic, Mylar, felt, leather, or any combination thereof. The flexible surface 18 and 20 can be made of spring steal, plastic, Mylar, felt, or combination of plastics but preferable rubber. The construction of the thumb screw 26 can be made of metal, plastic or rubber, or any combination thereof. Preferably, the thumb screw 26 is a combination of metal and hard rubber. Once the flexible surfaces 16, 18, and 20 are secured with rivets 40 to the rigid plate 32, rivets 43 come from under the flexible leather surface 16, into clip 22 and through second body 14 to receive cap 41, the rivets are set and the second body is secured to all three flexible surfaces. The next part of the construction is adding the square nut 46 to slot 42 then the first surface 12 and teeth 44 over the teeth 30 of the second surface 14. To secure these together, the thumb screw 26 is screwed through a hole in the first surface 12 and into the square nut 46. The thumb screw 26 is then tighten all the way so that the base of the thumb screw 26 locks into the arc of the first surface 12. The last part of the construction detail is placing the female end of the Chicago Screw 34 face down through the flexible surface holes, turning around the flexible surfaces so the female end of the Chicago Screw 34 fits through the slot 50 and into the fader button 24, washer 38 to be secured with the male part of the Chicago Screw 36.

Figure 3:
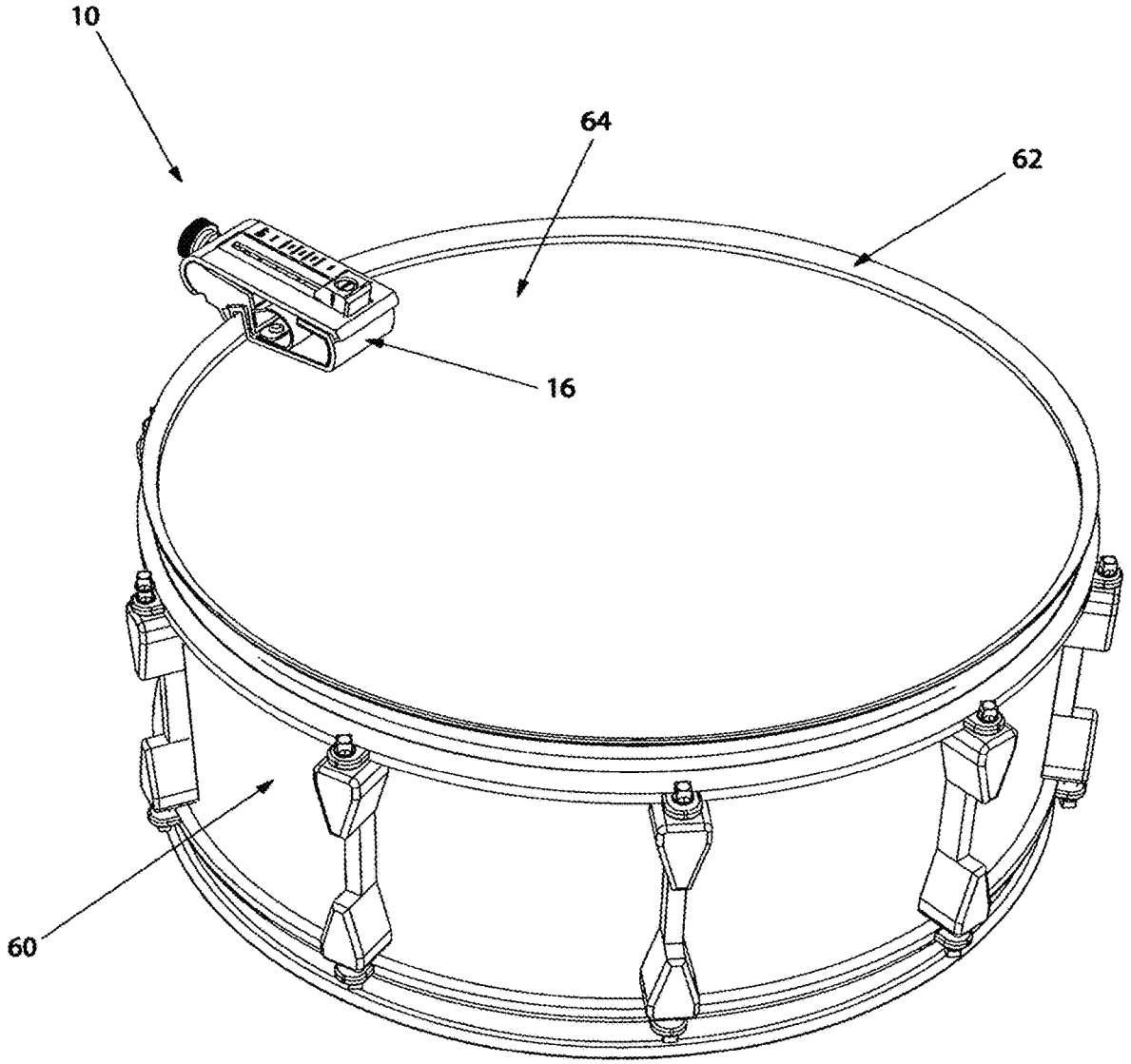
FIG. 3 is a perspective view of a drum damper of FIG. 1 on a drum.

FIG. 3 is a perspective view of the drum damper 10 located on a drum 6*b* and attached to a drum rim 62. The flexible surface 16 is coming in contact with drum head 64.

Figure 4:
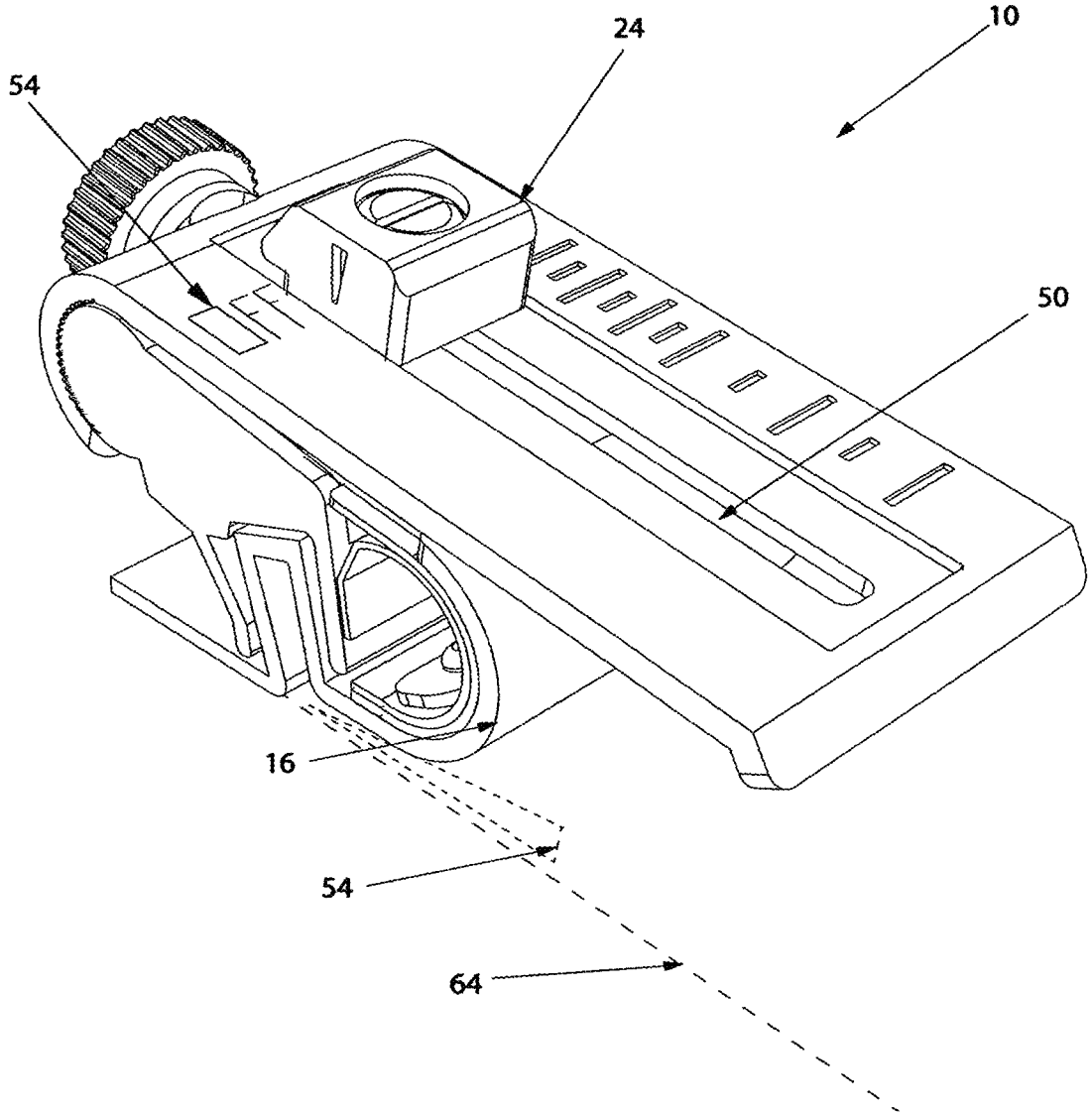
FIG. 4 is a perspective view of a drum damper of FIG. 1 showing the damper in the off position.

FIG. 4 is a perspective view of a drum damper 10 showing the fader button 24 slid to the off position 52. It shows the elevated flexible surface 16 not touching the drum head 64 when the fader button 24 utilizing the slot 50 is slid up to the off position 52. This function disengages the damper 10 and returns the vibration of the drum head 64 when struck with a stick, back to full sustain.

Figure 5:
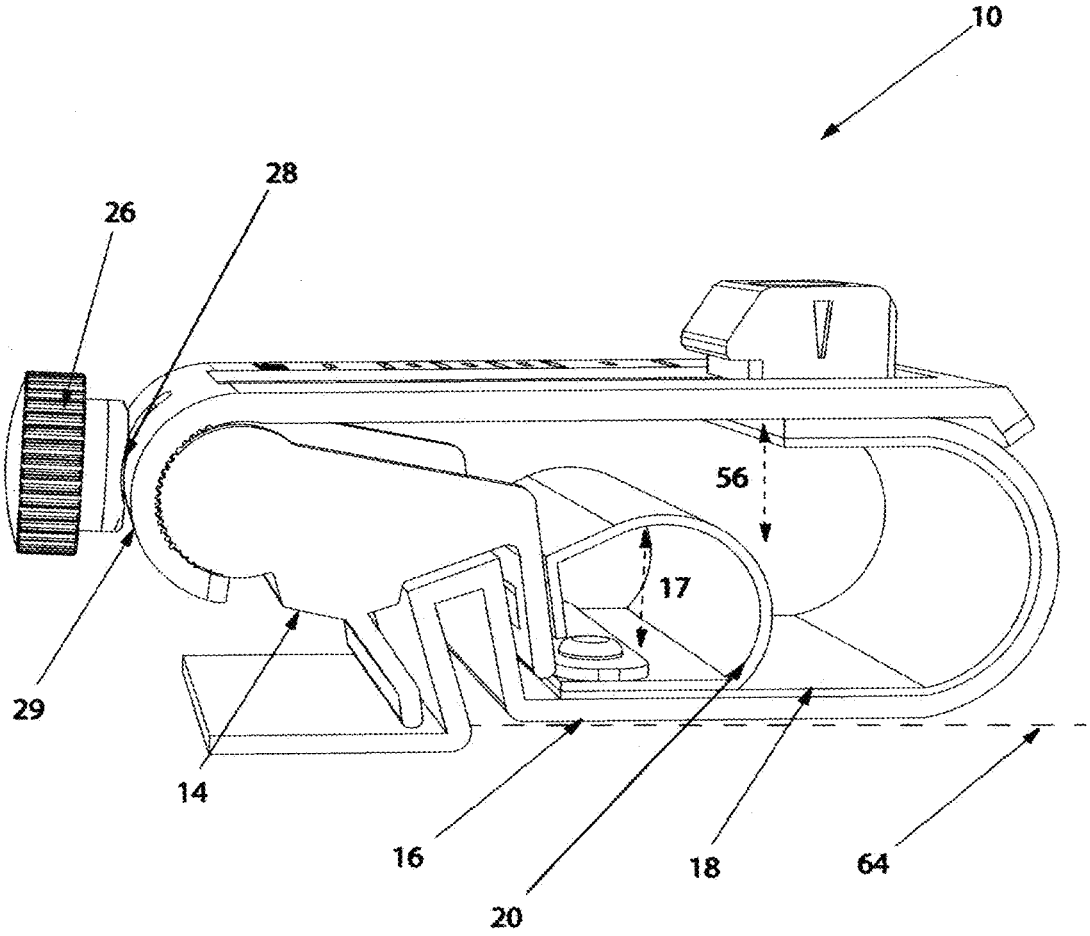
FIG. 5 is a side view of a drum damper of FIG. 1 showing the hinge and the locking thumb screw.

FIG. 5 is a side view of a drum damper 10 showing the locking thumb screw 26 the angle of arc 28 that matches the arc 29 of the first body 12. To engage the pressure of the drum damper 10 the user will need to unscrew the thumb screw 26 enough so that the teeth 44 of the first body 12 disengages with the teeth 30 of the second body 14. After the thumb screw 26 is loosened, the first body 12 can be free to pivot up or down. If the first body 12 pivots down and the thumb screw is tightened, the teeth will come together and lock the first body 12 in closer proximity to the drum head 64. The flexible surfaces between the first body 12 and the drum head 64 will put more downward dampening pressure 56 on the drum head 64.

Another feature shown in FIG. 5 is the construction of the thumb screw 26 with arc 28 that, once the user turns the screw to meet the matching arc 29 of first body 12, they come together to form a hump that the user can forcibly overcome to lock into place. This creates a self-locking thumb screw once tightened together. This feature prevents the first body 12 of damper 10 from ever loosening from vibrations of the drum during play.

Another feature shown in FIG. 5 comprises of a flexible surface 20 that is free at one end and can be rolled up and attached to the second body 14 via the hook in the second body 14. The flexible surface arc creates a downward force 17 that extends through to the bottom leather surface 16 keeping the damper 10 flexible surfaces taut against the drum head 64.

Figure 6:
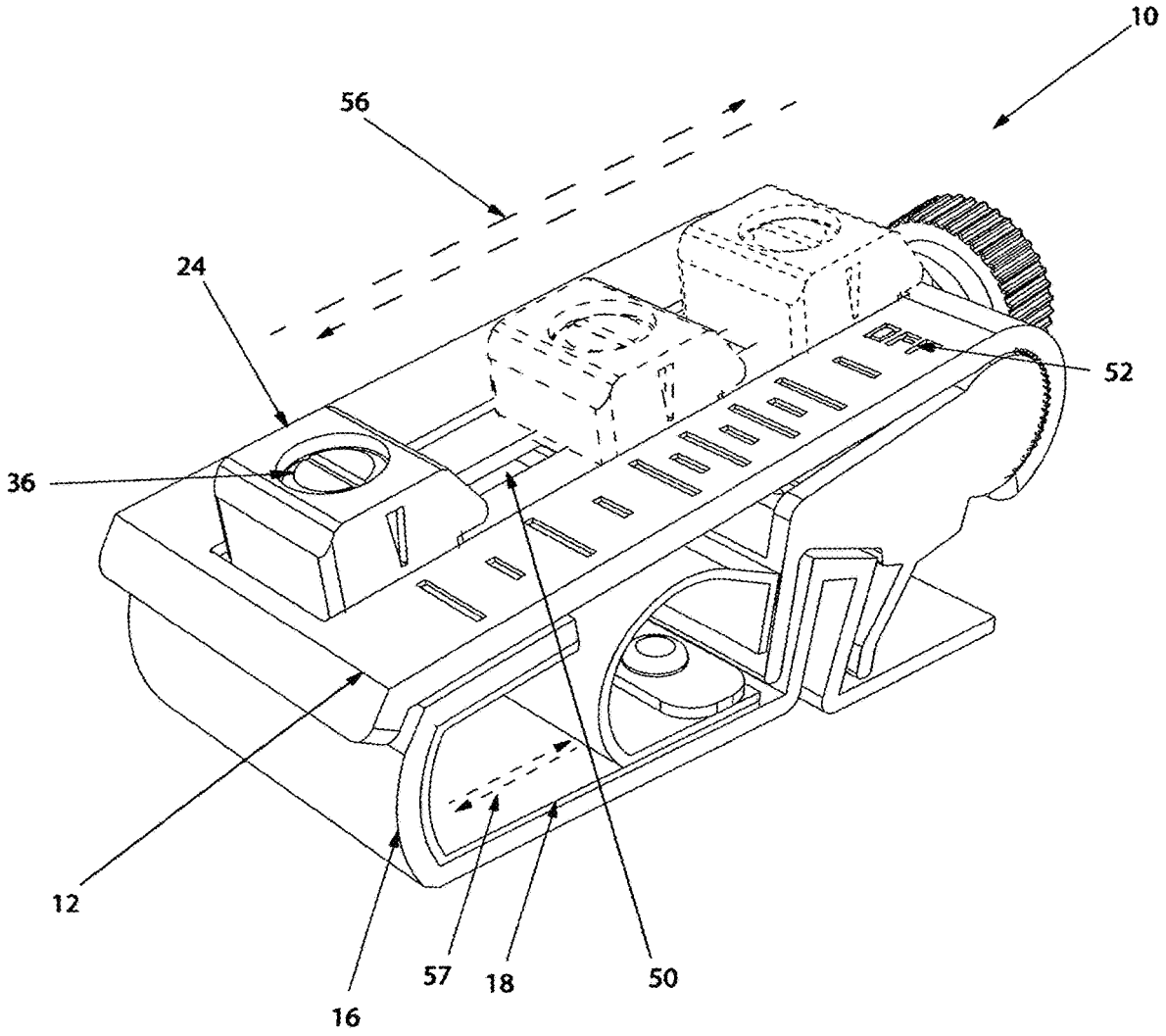
FIG. 6 is another perspective view of a drum damper of FIG. 1 showing the movement of the fader button.

FIG. 6 is an alternate perspective view of a drum damper 10 showing the movement 56 on the fader button 24. The fader button 24 can be moved by the user via the slot 50 in the first body 12. The fader button 24 and flexible surfaces 16 and 18 are attached via the Chicago screw 36 and when the fader button is moved 56 so do the flexible surface 16 and 18 shown moving 57. Also, the fader button 24 can be moved all the way to the top of the first body 12 to the off position 52 for no dampening of the drum head.

Figure 7:
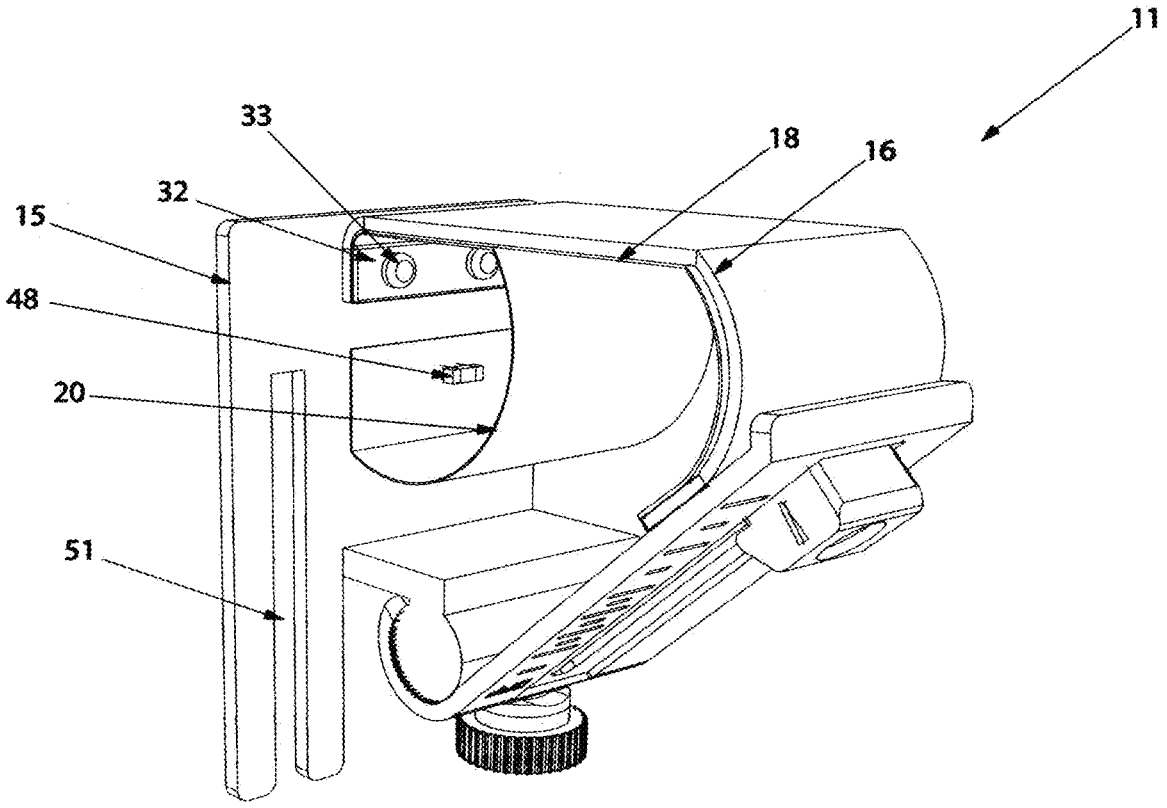
FIG. 7 is a perspective view of a drum damper according to an alternate embodiment.

FIG. 7 is a perspective view of a drum damper 11, which is similar to drum damper 10 of FIGS. 1-6. The drum damper 11 is configured to work in the inside of any drum particularly a base drum. The main body 15 is constructed with a slot 51 to accept existing screws within a drum, which can be utilized to attach and adjust drum damper 11 to the walls of drum shell. This drum damper holds the flexible surfaces 16 and 18 to the main body 15 via metal plate 32 and screws or rivets 33. Flexible surface 20 can be chosen by user to be looped and held with the hook 48 or not. The rest of the functions described of a drum damper 10 of FIGS. 1-6 are similar to drum damper 11.

Figure 8:
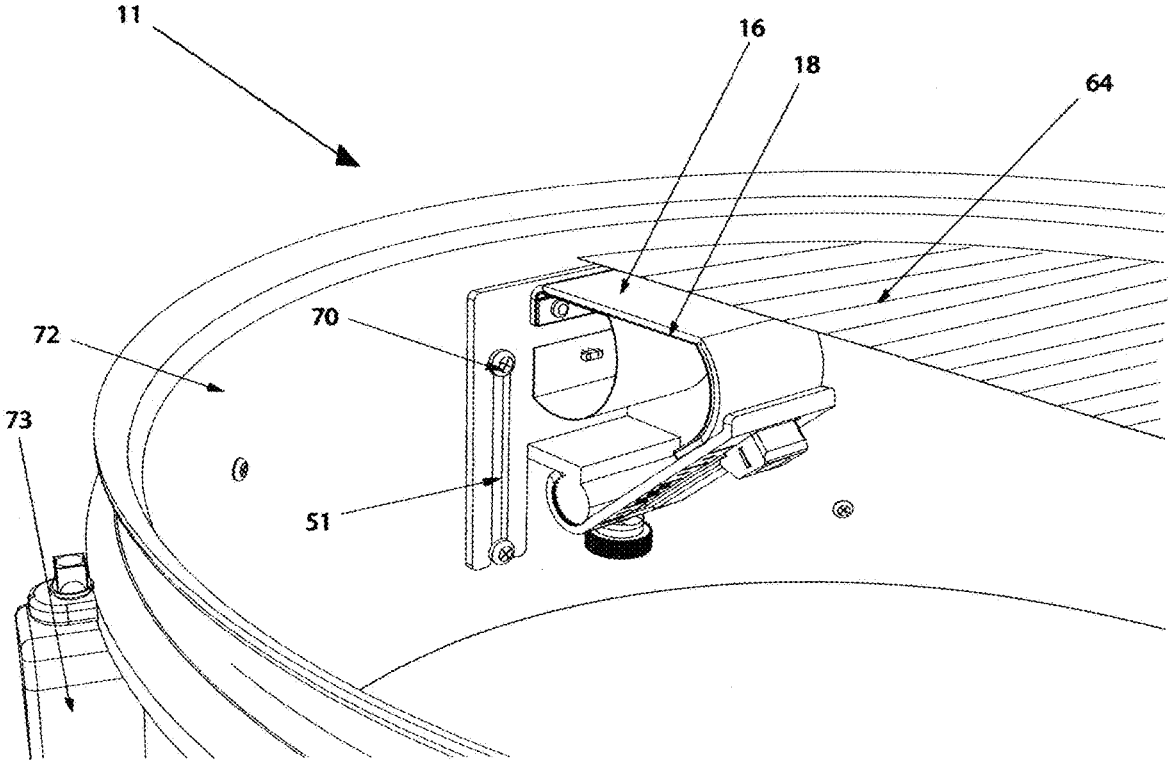
FIG. 8 is a perspective view of a drum damper of FIG. 7 mounted to the inside shell of a drum.

FIG. 8 is a perspective view of a drum damper 11 of FIG. 7 mounted to the inside shell of a drum 72. Drum damper 11 can be secured via the existing screws 70 of the drum shell 72 used to hold drum lugs 73 to the drum shell 72. The body 15 of drum damper 11 utilizes slot 51 to secure drum damper 11 to the drum. A user unscrews the screws 70, adds drum damper 11 and replaces existing screws 70 to hold drum damper 11 in place. Drum damper 11 can be slid in slot 51 until the flexible surfaces 16 and 18 make contact to the drum head 64. Once contact is made, user can tighten screws 70 to secure in place. The rest of the features of drum damper 11 are similar to drum damper 10.

Figure 9:
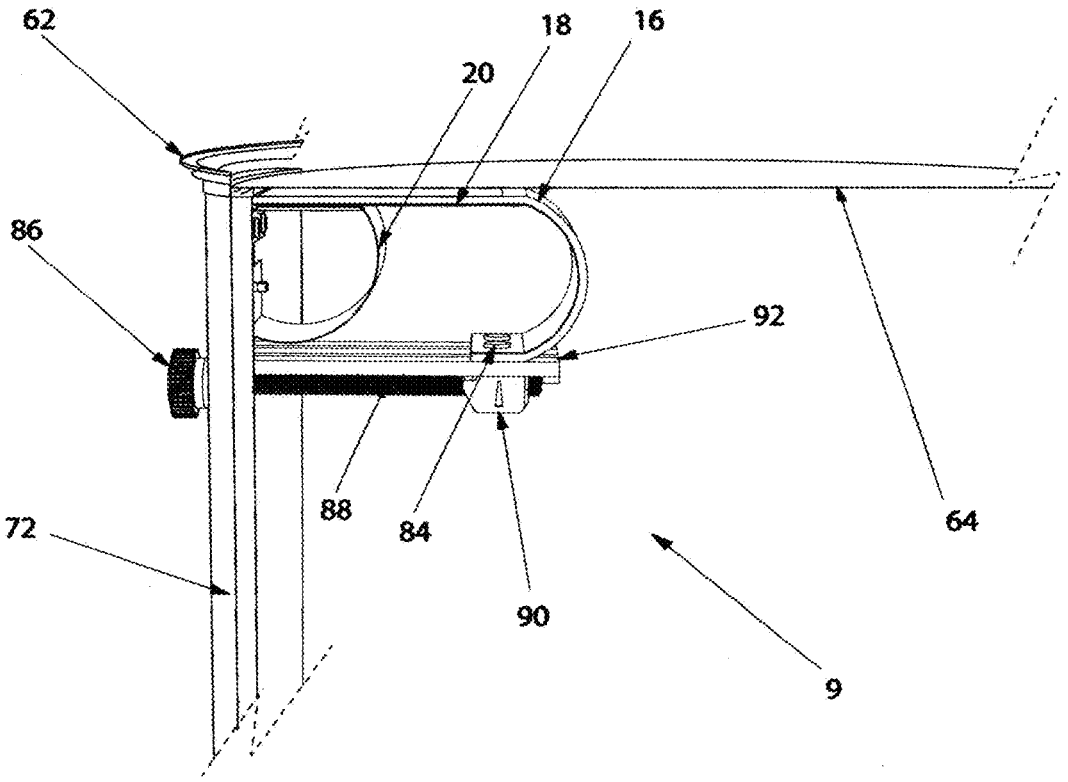
FIG. 9 is a side perspective view of a drum damper according to an alternate embodiment.

FIG. 9 is a side view of the drum damper 9, which is similar to drum damper 10 of FIGS. 1-6. Drum damper 9 is permanently affixed to the inside shell 72 of a drum. The construction details are as follows. The base 92 is attached to drum shell 72 and the flexible surfaces 16, 18, and 20 are permanently attached to the base 92. The base 92 has at least one slot 82 to allow the screw or screws 84 to pass freely though the base and to the fader 90 that hold the other end of the flexible surfaces 16 and 18. The thumb screw 86 incorporates one end for the user to turn and another end that is threaded 88 to pass through a hole in the drum shell 72 and extend to meet the threaded fader button 90.

Figure 10:
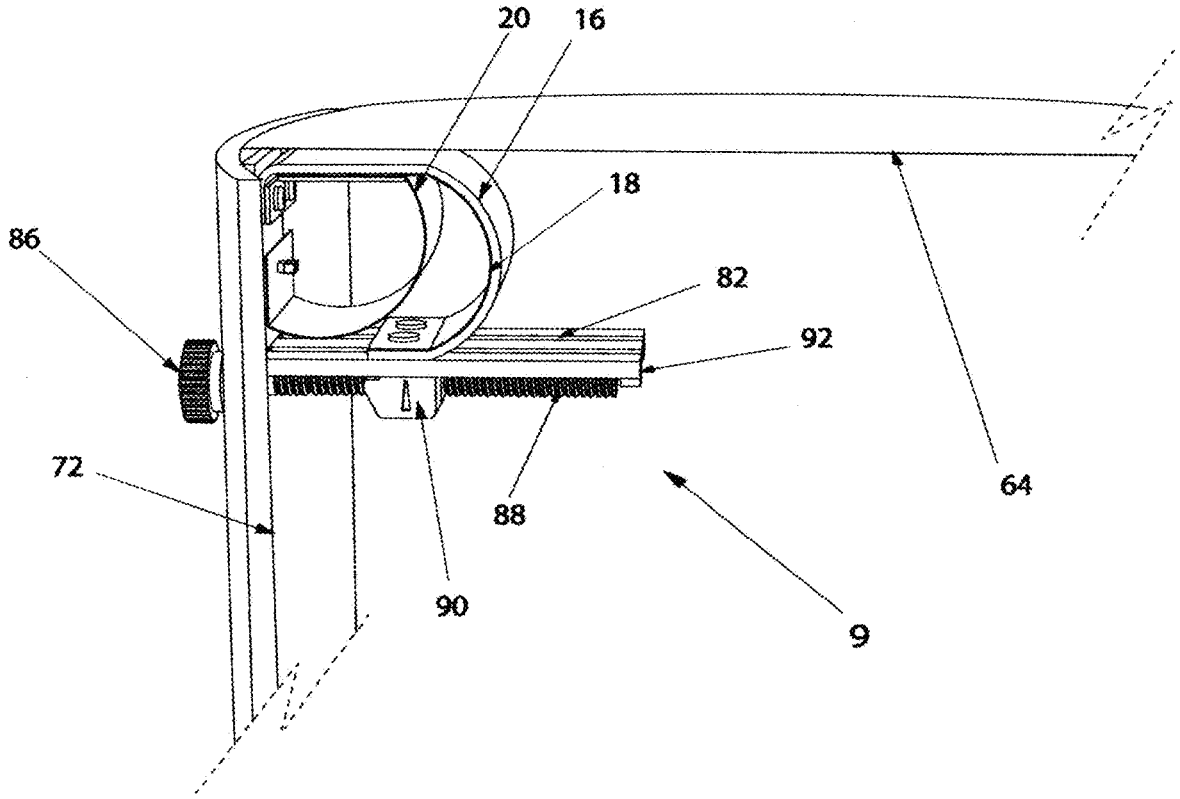
FIG. 10 is an alternate perspective view of a drum damper of FIG. 9.

FIG. 10 is another side view of the damper 9 of FIG. 9 showing the movement of the fader button and in turn dampening surfaces of 16, 18, and 20. When the user turns the thumb screw 86, the threads 88 connected to the thumb screw, act as a gear to move the fader button 90 along the slots 82 in the main plate 92. The fader button 90 is attached to the opposite end of the flexible surfaces 16 and 18. Flexible surface 20 has a springy quality and is rolled up to help support the flexible surface 16 to keep it firm against the underside of drum head 64. Flexible surface 18 also has a springy quality to help flexible surface 16 to stay firm against the underside of the drum head 64. For less dampening the user turns the thumb screw 86, moving the fader button 90 toward the drum shell 72. When the user turns the gear clockwise, the flexible surfaces are pulled by the fader button and rolled up and off the underside of the drum head 64 creating even dampening pressure to the drum head the entire way.

Figure 11:
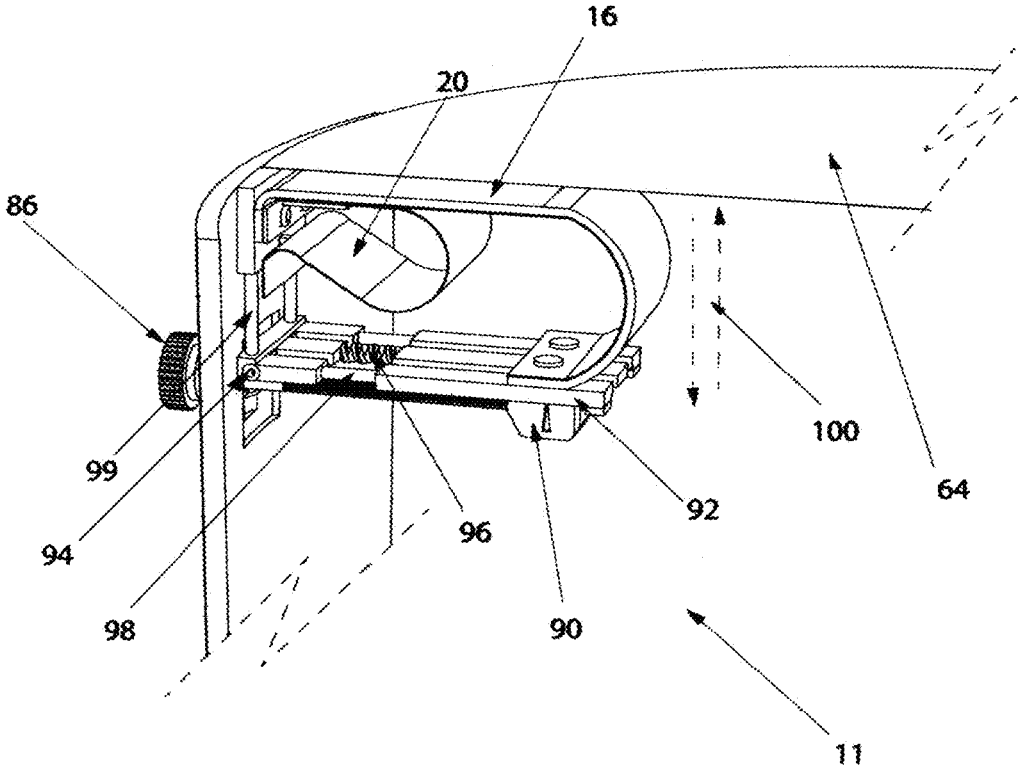
FIG. 11 is an alternate perspective view of a drum damper of the drum damper of FIG. 7.

FIG. 11 is a perspective view of another drum damper 11, which may be similar to drum dampers 9, 10, 11 of FIGS. 1, 7, and 9. This drum damper applies many of the same principles of drum damper 9 and 10 previously described above. The difference of this drum damper 11 from damper 9, is that the main plate 92 can swivel utilizing the hinge joint 94. The user can create more dampening force or pressure 100 to drum head 64 by sharpening the angle of the main plate 92 forcing the flexible materials 16 and 20 up against the drum head 64 to slow vibration down faster after the drum is struck.

Also shown in FIG. 11 are support pistons 98 and 99 and a coiled spring 96, all of which work together for the user to adjust and choose the angle of the main plate 92, thus changing the pressure of the damper to the drum head. The coiled spring could be replaced by two magnets of opposite polarity if needed. Vertical support pistons 99 are used for vertical movement of the main plate 92 while horizontal pistons 98 are used for horizontal movement of the main plate 92.

Also, FIG. 11 shows a flexible rubber surface 20 in a firmer orientation to the drum head 64. This unique rolling feature of the flexible surface 20 is helpful for applying the right kind of pressure on the leather surface 16 coming in contact with the drum head 64 for even dampening.

Figure 12:
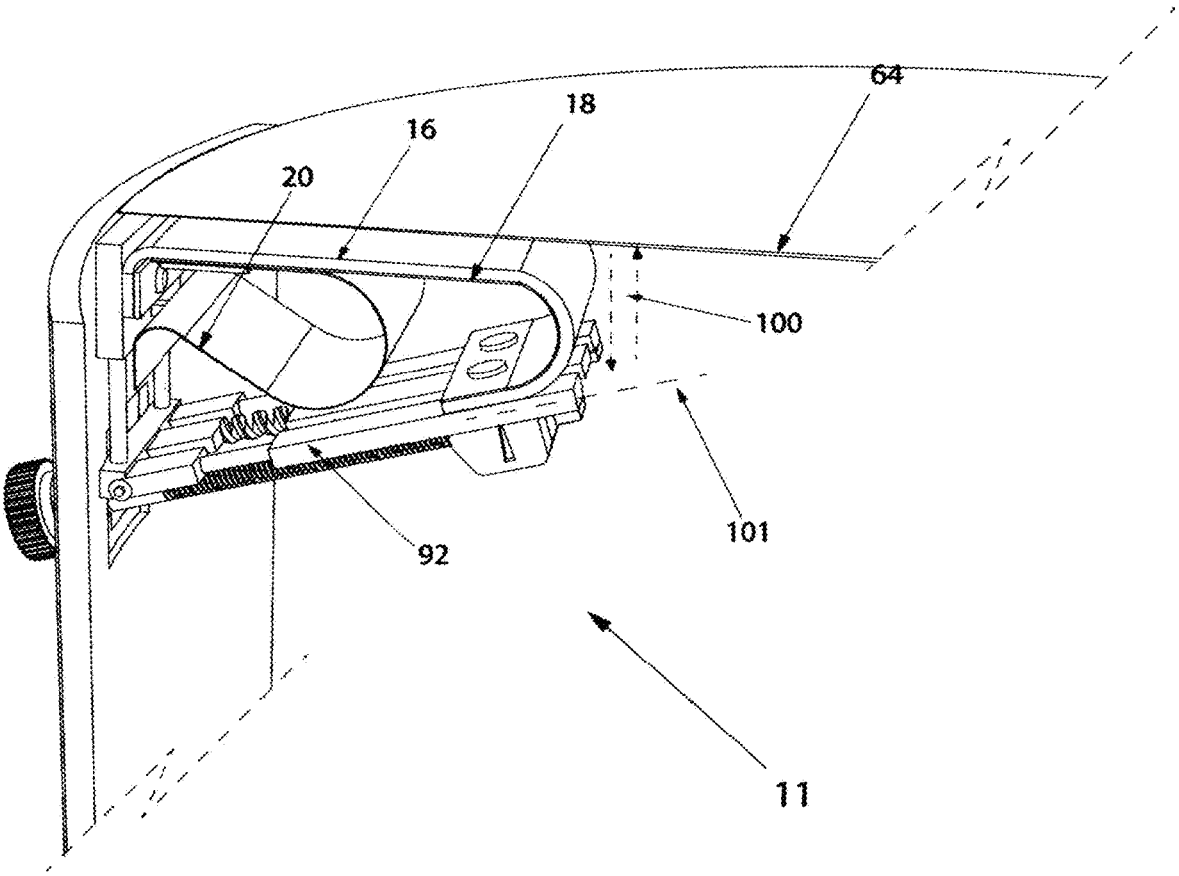
FIG. 12 is an alternate perspective view of a drum damper of FIG. 11.

FIG. 12 is a perspective view of the drum damper 11 of FIG. 11 showing a sharper angle 101 of the main plate 92 thus increasing the force or pressure 100 of the flexible surfaces 16, 18, and 20 to the underside of the drum head 64.

Figure 13:
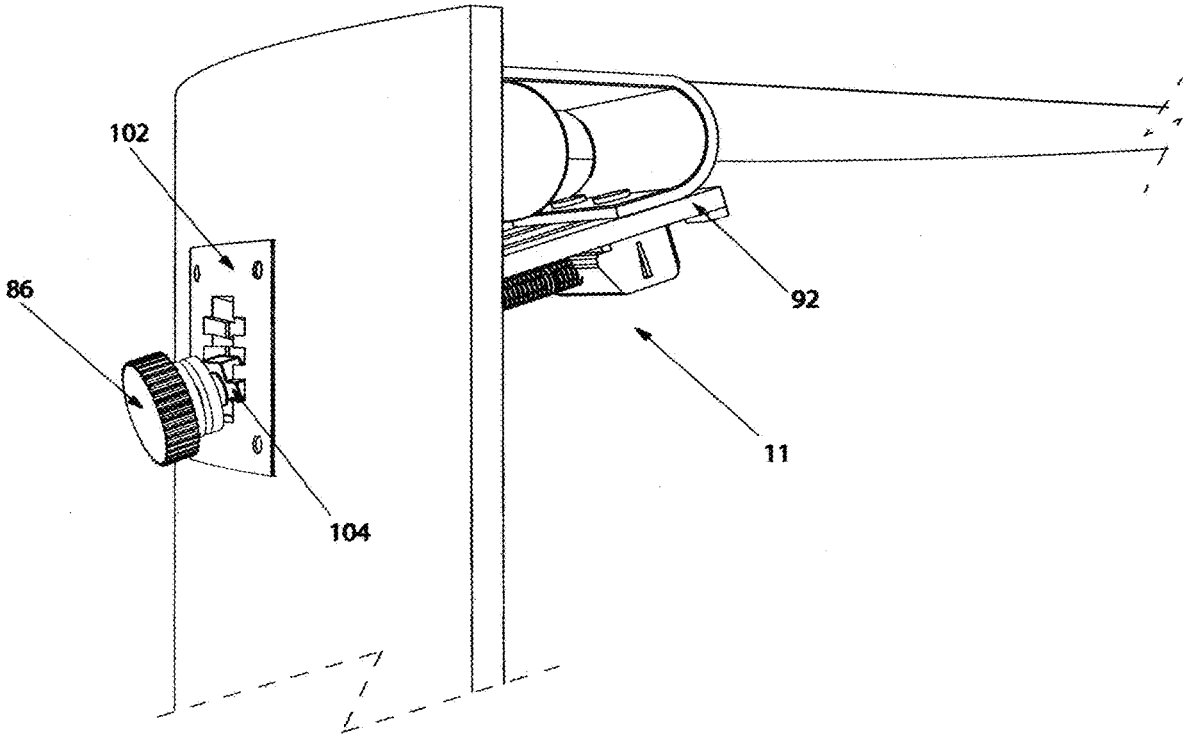
FIG. 13 is an alternate perspective view of a drum damper of FIG. 11.

FIG. 13 is another perspective view of the drum damper 11 of FIG. 11 and a 3-gear latch system 102 on the outside of a drum. This latch system determines the angle of the main plate 92 by three differently angled slots within 102 that accept a protrusion 104 comprised in the thumb screw 86. The thumb screw can be pulled out of these slots and adjusted into one of the threes slots. FIG. 13 shows the bottom slot utilized in order for the user to get a sharper angle of the main plate 92 adding pressure to the drum head for more aggressive drum dampening.

Figure 14:
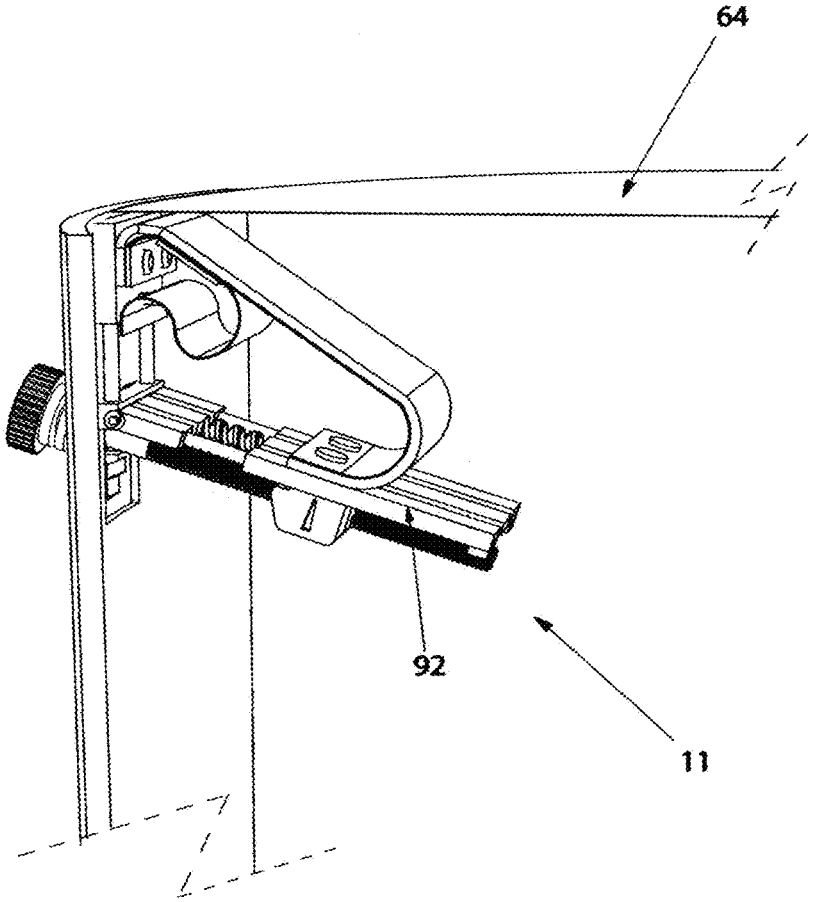
FIG. 14 is an alternate perspective view of a drum damper of FIG. 11

FIG. 14 shows a perspective view of the drum damper 11 of FIG. 11 with the main plate 92 angled away from the drum head 64. The drum damper 11 is now in the off position in relation to the drum head 64.

Figure 15:
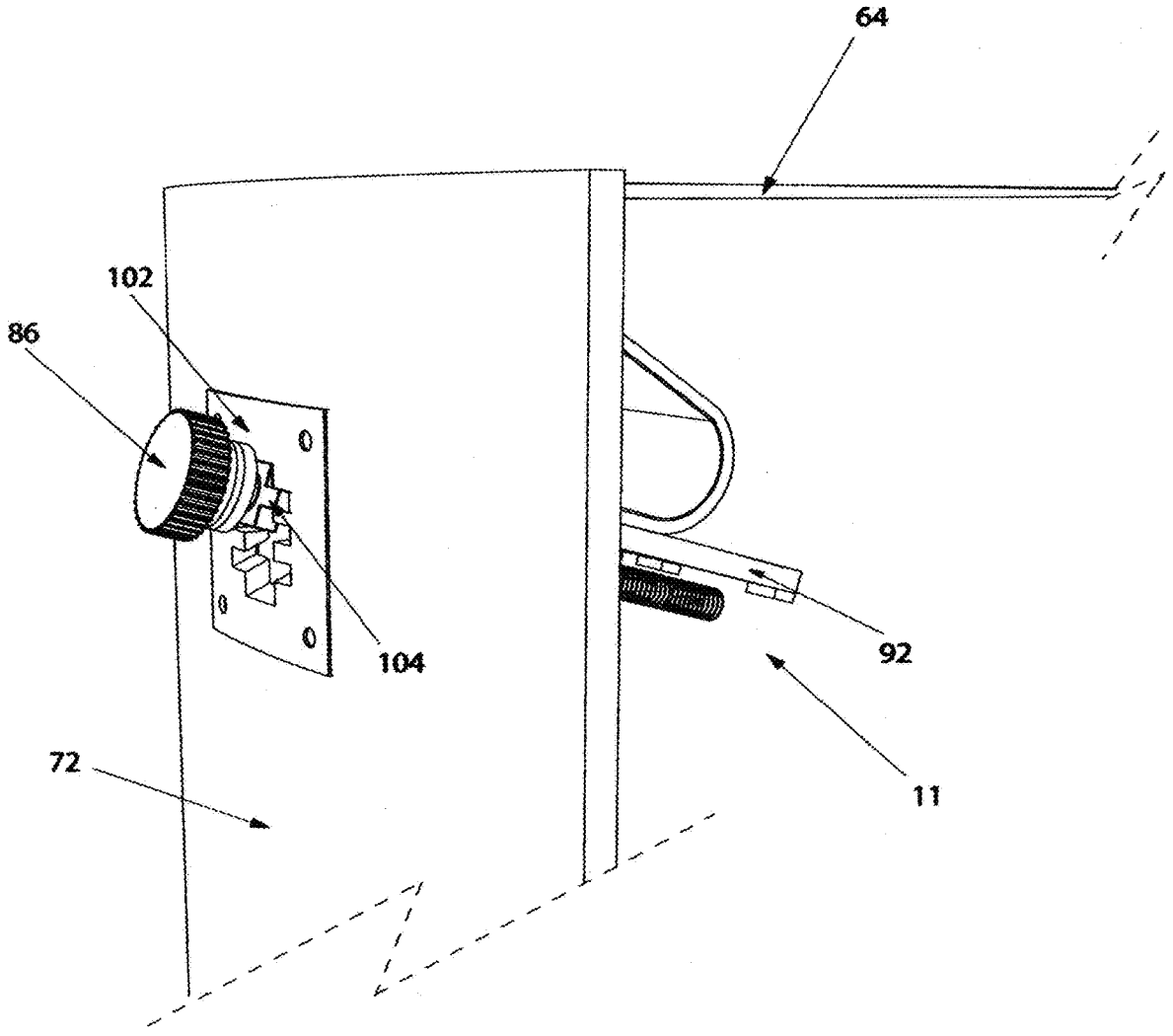
FIG. 15 is an alternate perspective view of a drum damper of FIG. 11.

FIG. 15 shows a perspective view of the drum damper 11 of FIG. 11 from the outside of a drum shell 72. The 3-gear latch system 102 is showing the thumb screw 86 and its protrusion 104 sitting in the top slot angled down which puts the drum damper 11 in the off position in relation to the drum head 64.

What is claimed is:

1. A drum damper, comprising:

a first body having a first surface and a second surface, comprising:

a slot; and a fader button positioned on the first surface of the first body and configured to slide along the slot;

a second body connected with the second surface of the first body and configured to releasably attach with a drum; and flexible bodies connected with the second body, configured to dampen sound or vibration from a drum head and be in contact with the drum head, and connected with the fader button through the slot, wherein when the fader button slides along the slot, the flexible bodies increase or reduce surface area contact with the drum head;

wherein the second body comprises a clip configured to releasably connect the second body with a top surface of a drum rim wherein the flexible bodies are configured to contact a top surface of the drum head.

2. The drum damper of claim 1, wherein the first body includes teeth and the second body includes teeth, and wherein the teeth of the first body and the teeth of the second body are interfaceable, wherein when the teeth of the first body and the teeth of the second body interface, rotational movement between the first body and the second body is restricted.

3. The drum damper of claim 2, further comprising:

a thumb screw that is interfaceable with a lateral slot of the first body wherein an angle of connection between the first body and the second body can be adjusted by changing where the teeth of the first body and the teeth of the second body interface.

4. The drum damper of claim 2, further comprising:

a thumb screw comprised of an arc at its base that when fully tightened against the matching arc of the first surface, reaches a resistant hump, that after enough force by the user tuning it over the hump, releases the pressure and is locked into place and can not back out.

5. The drum damper of claim 2, further comprising:

a thumb screw comprised of an arc at its base that when fully tightened against the matching arc of the first surface, reaches a resistant hump, that after enough force by the user tuning it over the hump, releases the pressure and is locked into place and can not back out.

6. The drum damper of claim 1, wherein the flexible bodies comprise:

a first flexible body configured to contact the drum head;

a second flexible body configured to provide support for the first flexible body; and a third flexible body connected with the second body and configured to connect together the first flexible body and the second flexible body, wherein when the fader button slides along the slot, the first flexible body and the second flexible body move in unison.

7. The drum damper of claim 1, wherein the fader button is configured to control an amount of surface area contact between the flexible bodies and the drum head.

8. The drum assembly of claim 7, wherein the first body is rotatably coupled with the aperture of the drum shell at a swivel.

9. The drum assembly of claim 7, wherein the first body is fixedly coupled with the aperture of the drum shell wherein rotational motion is restricted.

10. A drum damper, comprising:

a first body having a first surface and a second surface, comprising:

a slot; and a fader button positioned on the first surface of the first body and configured to slide along the slot;

a second body connected with the second surface of the first body and configured to releasably attach with a drum; and flexible bodies connected with the second body, configured to dampen sound or vibration from a drum head and be in contact with the drum head, and connected with the fader button through the slot, wherein when the fader button slides along the slot, the flexible bodies increase or reduce surface area contact with the drum head;

wherein the second body comprises a slot configured to releasably attach with one or more screws of an internal surface of a drum shell wherein the flexible bodies are configured to contact a bottom surface of the drum head.

11. The drum damper of claim 10, wherein the first body includes teeth and the second body includes teeth, and wherein the teeth of the first body and the teeth of the second body are interfaceable, wherein when the teeth of the first body and the teeth of the second body interface, rotational movement between the first body and the second body is restricted.

12. The drum damper of claim 11, further comprising:

a thumb screw that is interfaceable with a lateral slot of the first body wherein an angle of connection between the first body and the second body can be adjusted by changing where the teeth of the first body and the teeth of the second body interface.

13. The drum damper of claim 11, further comprising:

a thumb screw comprised of an arc at its base that when fully tightened against the matching arc of the first surface, reaches a resistant hump, that after enough force by the user tuning it over the hump, releases the pressure and is locked into place and can not back out.

14. The drum damper of claim 10, wherein the flexible bodies comprise:

a first flexible body configured to contact the drum head;

a second flexible body configured to provide support for the first flexible body; and a third flexible body connected with the second body and configured to connect together the first flexible body and the second flexible body, wherein when the fader button slides along the slot, the first flexible body and the second flexible body move in unison.

15. The drum damper of claim 10, wherein the fader button is configured to control an amount of surface area contact between the flexible bodies and the drum head.

16. The drum assembly of claim 15, wherein the first body is rotatably coupled with the aperture of the drum shell at a swivel.

17. The drum assembly of claim 15, wherein the first body is fixedly coupled with the aperture of the drum shell wherein rotational motion is restricted.

18. A drum damper, comprising:

a first body having a first surface and a second surface, comprising:

a slot; and a fader button positioned on the first surface of the first body and configured to slide along the slot;

a second body connected with the second surface of the first body and configured to releasably attach with a drum; and flexible bodies connected with the second body, configured to dampen sound or vibration from a drum head and be in contact with the drum head, and connected with the fader button through the slot, wherein when the fader button slides along the slot, the flexible bodies increase or reduce surface area contact with the drum head;

wherein the first body includes teeth and the second body includes teeth, and wherein the teeth of the first body and the teeth of the second body are interfaceable, wherein when the teeth of the first body and the teeth of the second body interface, rotational movement between the first body and the second body is restricted.

19. The drum damper of claim 18, further comprising:

a thumb screw that is interfaceable with a lateral slot of the first body wherein an angle of connection between the first body and the second body can be adjusted by changing where the teeth of the first body and the teeth of the second body interface.

20. The drum damper of claim 18, wherein the flexible bodies comprise:

a first flexible body configured to contact the drum head;

a second flexible body configured to provide support for the first flexible body; and a third flexible body connected with the second body and configured to connect together the first flexible body and the second flexible body, wherein when the fader button slides along the slot, the first flexible body and the second flexible body move in unison.

21. The drum damper of claim 18, wherein the fader button is configured to control an amount of surface area contact between the flexible bodies and the drum head.

22. The drum assembly of claim 21, wherein the first body is rotatably coupled with the aperture of the drum shell at a swivel.

23. The drum assembly of claim 21, wherein the first body is fixedly coupled with the aperture of the drum shell wherein rotational motion is restricted.

24. A drum damper, comprising:

a first body having a first surface and a second surface, comprising:

a slot; and a fader button positioned on the first surface of the first body and configured to slide along the slot;

a second body connected with the second surface of the first body and configured to releasably attach with a drum; and flexible bodies connected with the second body, configured to dampen sound or vibration from a drum head and be in contact with the drum head, and connected with the fader button through the slot, wherein when the fader button slides along the slot, the flexible bodies increase or reduce surface area contact with the drum head;

wherein the flexible bodies comprise:

a first flexible body configured to contact the drum head;

a second flexible body configured to provide support for the first flexible body; and a third flexible body connected with the second body and configured to connect together the first flexible body and the second flexible body, wherein when the fader button slides along the slot, the first flexible body and the second flexible body move in unison.

25. The drum damper of claim 24, wherein the fader button is configured to control an amount of surface area contact between the flexible bodies and the drum head.

26. The drum damper of claim 25, wherein the first body is rotatably coupled with the aperture of the drum shell at a swivel.

27. The drum damper of claim 25, wherein the first body is fixedly coupled with the aperture of the drum shell wherein rotational motion is restricted.

* * * * *